United States Patent [19]

Etter et al.

[11] Patent Number: 4,474,254

[45] Date of Patent: Oct. 2, 1984

[54] PORTABLE DRILLING MUD SYSTEM

[76] Inventors: Russell W. Etter; James M. Briggs, both of 1702 E. Highway 82, Gainesville, Tex. 76240

[21] Appl. No.: 439,395

[22] Filed: Nov. 5, 1982

[51] Int. Cl.[3] ..... E21B 21/06

[52] U.S. Cl. ..... 175/206; 366/136; 210/188

[58] Field of Search ..... 175/206, 66; 173/28; 210/188, 167, 260, 262; 280/5 A; 366/169, 167, 136, 137, 159

[56] References Cited

U.S. PATENT DOCUMENTS

| | | | |
|---|---|---|---|
| 2,582,802 | 1/1952 | Terrell, Jr. | 366/136 X |
| 2,786,651 | 3/1957 | Mickle | 255/24 |
| 2,923,151 | 2/1960 | Engle et al. | 175/206 |
| 2,941,783 | 6/1960 | Stinson | 175/206 |
| 3,040,822 | 6/1962 | Graham et al. | 175/70 |
| 3,713,499 | 1/1973 | Arscott et al. | 175/66 |
| 3,968,845 | 7/1976 | Chaffin | 175/60 |
| 4,059,281 | 11/1977 | Evans | 280/5 A |
| 4,215,753 | 8/1980 | Champness | 175/17 |
| 4,390,286 | 6/1983 | Regaldo | 366/136 X |

*Primary Examiner*—James A. Leppink
*Assistant Examiner*—Thuy M. Bui
*Attorney, Agent, or Firm*—Hubbard, Thurman, Turner & Tucker

[57] ABSTRACT

A portable well drilling mud storage and recirculation unit includes a mud storage tank mounted on an over-the-road semi-trailer having an engine driven circulating pump mounted onboard and adapted to withdraw mud from the tank for circulation to the well and for recirculation through a set of mud agitating nozzles disposed in the bottom of the tank. A mud degassing vessel, a solids separator unit and an additive blending unit are all mounted above the tank. The degassing vessel is supported by hydraulic cylinder actuators for movement between a retracted transport position and a vertically elevated working position.

13 Claims, 7 Drawing Figures

PORTABLE DRILLING MUD SYSTEM

BACKGROUND OF THE INVENTION

Field of the Invention

The present invention pertains to a portable well drilling fluid circulation, cleaning and storage unit including gas and shale separating components, a storage and recirculating tank, a circulating and charging pump and a power source mounted on board a semi-trailer.

BACKGROUND

In the drilling of oil wells and the like the components for handling, recirculating, and cleaning the drilling fluid are normally separately transported to and from the well site and interconnected at the well site preparatory to drilling the well. Moreover, it is also common practice to provide a drilling fluid storage reservoir by simply digging a pit in the ground at the well site to serve as storage means for the recirculated fluid. However, these prior art practices for providing the drilling fluid circulation system are inefficient and environmentally damaging, particularly considering the use of in-the-ground mud pits or the like. Accordingly, there has been a longfelt need for improvements in drilling fluid circulation and storage equipment which has, prior to the present invention, gone substantially unresolved in the art of well drilling systems.

SUMMARY OF THE INVENTION

The present invention provides an improved drilling fluid or "mud" system which is arranged to be highly portable and includes substantially all of the components required for recirculating mud from the well bore to the inlet manifold of a high pressure circulating pump. In accordance with one aspect of the present invention there is provided a semi-trailer unit including a mud storage and circulating tank mounted thereon. The trailer unit also includes an engine driven circulating pump which is adapted to have its suction or inlet line connected to the storage tank and is also adapted to have its discharge line connected to an improved arrangement of mud circulating and agitating nozzles disposed in the tank whereby mud may be continually circulated and mixed during storage thereof to minimize freezing and to maintain various mud additives thoroughly mixed or dispersed.

In accordance with another aspect of the present invention there is provided a portable drilling mud system wherein certain mud treating and cleaning components are mounted on the trailer and are advantageously located on a deck structure disposed generally over the top of a mud storage tank. The mud cleaning components include a gas separator apparatus and a solids separator or shale shaker apparatus which are mounted on the top deck of the storage tank. The gas separator apparatus comprises a vessel having a suitable inlet connection for receiving drilling mud from the well circulation system for separating gas entrained in the mud and provided with means for discharging the degassed mud to a solids separating apparatus mounted above the storage tank and adapted to discharge the clean mud directly into the storage tank. A mud additive blending or mixing unit is also advantageously located on the top deck of the mud storage tank.

In accordance with yet another aspect of the present invention the gas separator vessel is provided with a unique mounting arrangement on the trailer whereby the vessel may be elevated into a working position by hydraulic actuator means and may be lowered into a transport position to provide suitable bridge and tunnel clearance for highway transport of the portable mud system.

In accordance with still a further aspect of the present invention there is provided an improved arrangement of piping for selectively connecting a mud circulating pump on a portable mud circulating and storage unit to the on board storage tank, to a source for loading mud into the storage tank, and to discharge line for circulating mud through a unique mud agitating nozzle system or, alternatively or concomitantly, through the mud blending unit and then into the storage tank. The piping system also provides for either discharging mud partially or completely from the circulating pump back to the storage tank or to charge the inlet of a high pressure mud circulating pump or the like.

In addition to the features and advantages described hereinabove the portable drilling mud system of the present invention is substantially self contained in that the prime mover on board the trailer may be simultaneously connected to the mud circulating pump and to an electric generator unit for providing electric energy to operate a solids separator apparatus and to provide power to an onboard hydraulic power supply unit for raising and lowering the mud degassing vessel. The construction of the trailer, and the arrangement of the storage tank and associated components is particularly unique including the feature wherein a portion of the storage tank supporting frame includes mud circulation piping for circulating mud back into the tank from the circulating pump.

Those skilled in the art will recognize the abovedescribed features and superior aspects of the present invention as well as other advantages thereof upon reading the detailed description which follows in conjunction with the drawings.

DESCRIPTION OF THE PREFERRED EMBODIMENT

Figures 1, 6:
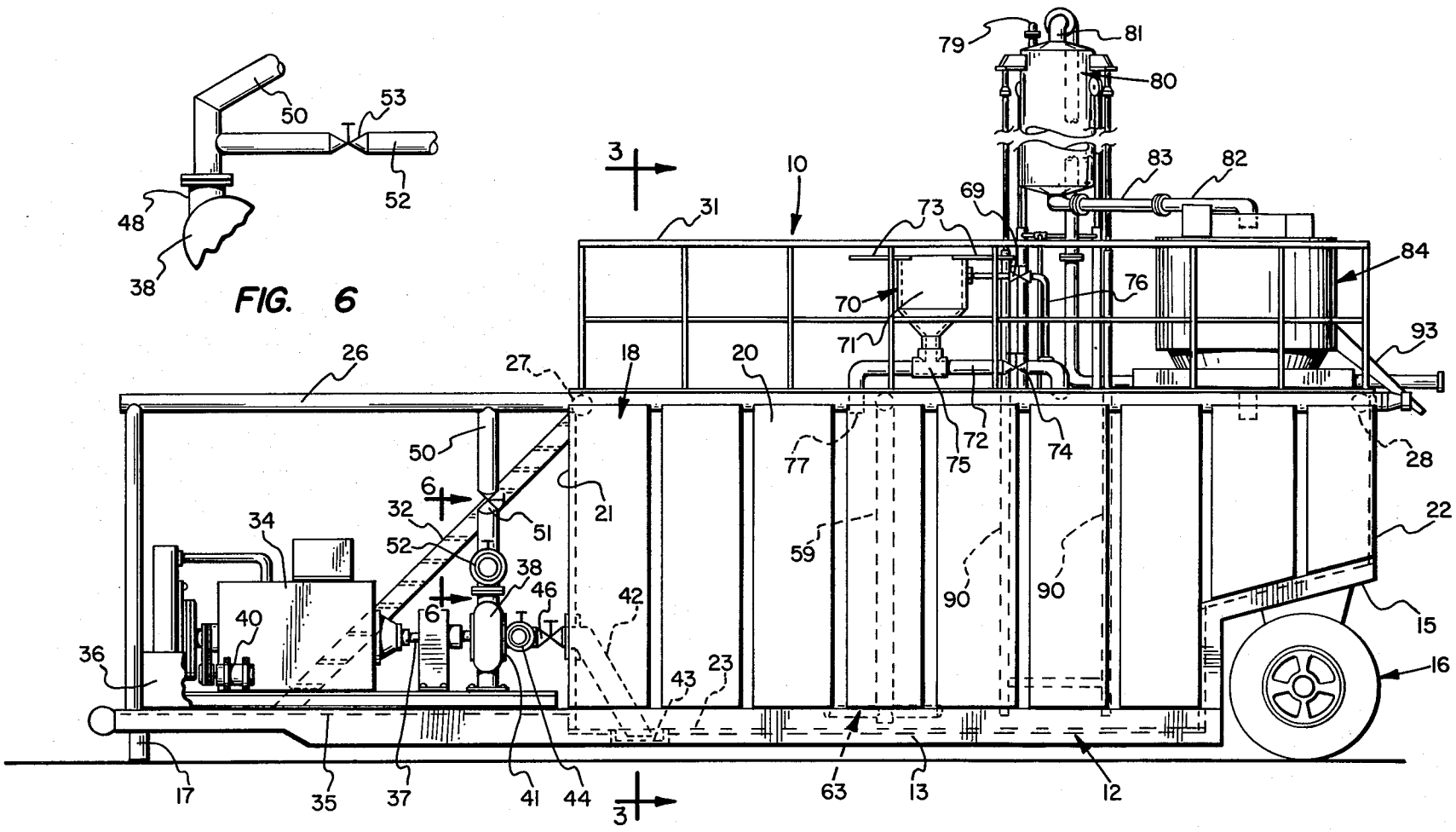
FIG. 1 is a side elevation of the portable drilling mud system of the present invention.
FIG. 6 is a detail view taken along the line 6—6 of FIG. 1.

In the description which follows like parts are marked throughout the specification and drawings with the same reference numerals, respectively. The drawings are not necessarily to scale and certain features of the invention may be exaggerated in scale or shown in schematic form in the interest of clarity and conciseness.

Figure 2:
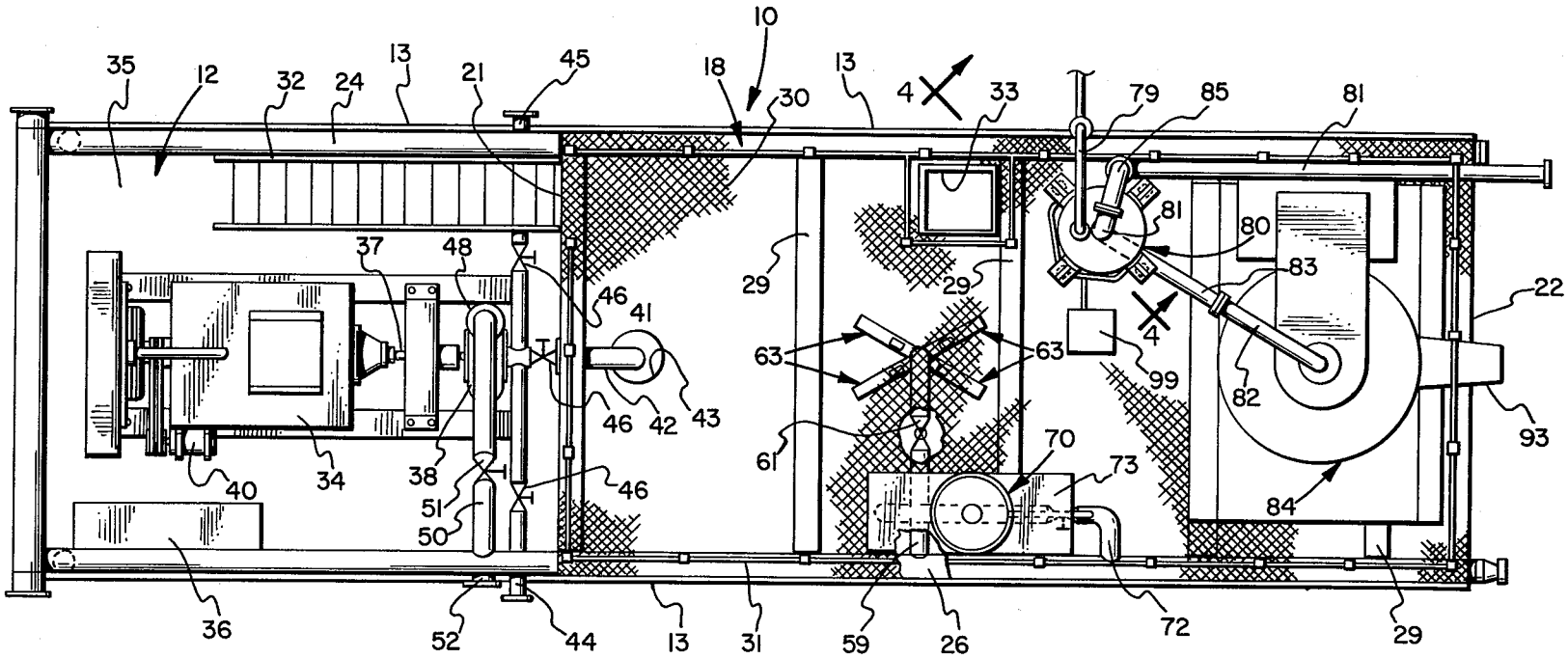
FIG. 2 is a plan view of the drilling mud system illustrated in FIG. 1.
Figure 3:
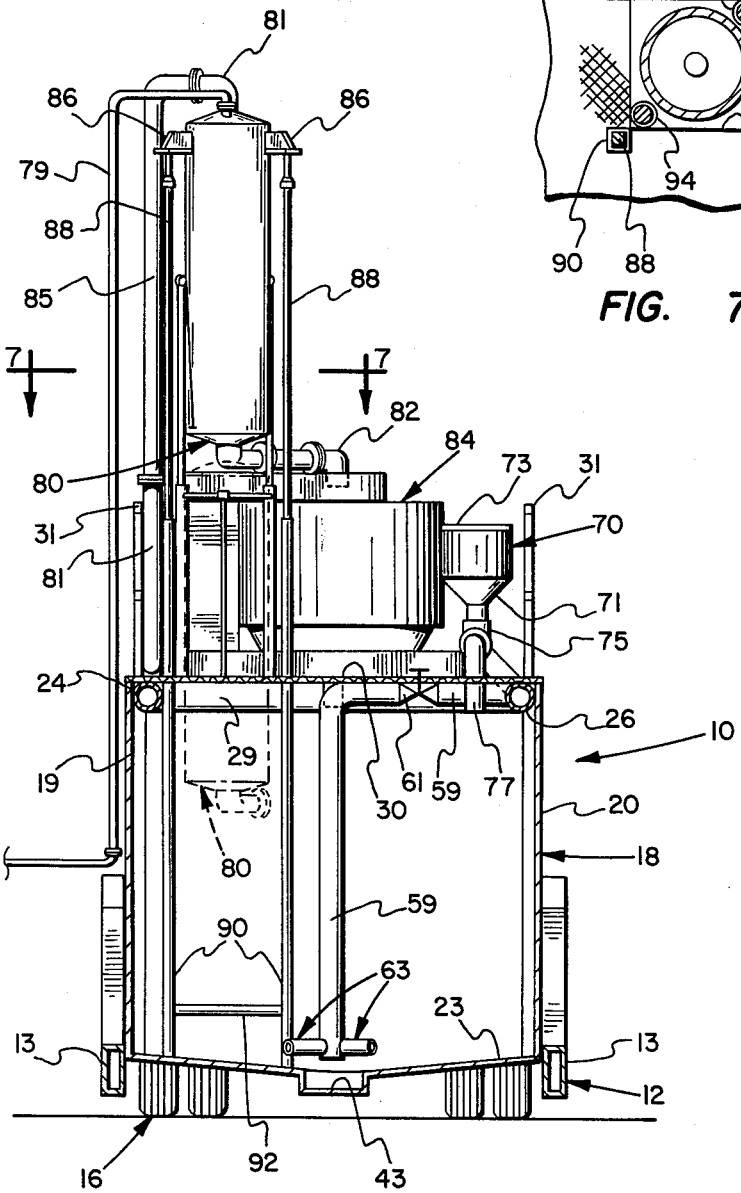
FIG. 3 is a section view taken along the line 3—3 of FIG. 1.

Referring to FIGS. 1, 2 and 3 there is illustrated an improved self contained mud circulating and storage system particularly adapted for use in conjunction with drilling oil wells and the like and generally designated by the numeral 10. The mud circulating and storage system 10 is characterized by a self contained semi-trailer having an undercarriage including a frame 12 comprising elongated spaced apart side sills or rail members 13. The rail members 13 are suitably joined to further frame structure including a transverse beam 11 at the forward end and a recessed perimeter frame 15 at the rear end of the trailer and adapted to be supported by a single axle dual wheel, rubber tired bogie 16. The bogie 16 may be of a conventional over-the-road semi-trailer construction including dual rubber tired wheels and suitable wheel braking apparatus. The forward end of the frame 12 includes a centrally mounted coupling pin 17 adapted for connecting the unit 10 to an over-the road truck tractor, not shown.

The unit 10 includes an elongated drilling fluid or mud circulating and storage tank supported on the frame 12 and generally designated by the numeral 18. The tank 18 includes parallel longitudinal sidewalls 19 and 20, front and rear walls 21 and 22, respectively, and a laterally sloping bottom wall 23. The walls 19, 20, 21 and 22 may be fabricated of corrugated sheet steel or the like and suitably welded to the bottom wall and to each other to form a unitary rigid tank structure. Along at least the top of the sidewalls 19 and 20 extend generally horizontal longitudinal frame members 24 and 26 which are characterized as cylindrical steel pipe sections closed at their respective opposed ends. The opposed end walls 21 and 22 may also be suitably welded along their top edges to frame and stiffening members 27 and 28, respectively, which are interconnected to the frame members 24 and 26.

As shown in FIGS. 2 and 3, suitable spaced apart transverse beams 29 are provided interconnecting the side frame members 24 and 26 and are adapted to support decking disposed across the top of the tank 18 and generally designated by the numeral 30. The decking 30 may, for example, comprise sections of expanded steel or solid sheeting as desired. Suitable hand railing 31 may be fixed to the upper frame members of the tank 18 and along the peripheral edges of the deck 30, as illustrated. A boarding ladder 32 is provided at the front wall 21 for gaining access to the deck 30. A manway 33, FIG. 2, is formed in the deck 30 and is enclosed by a portion of railing 31.

The portion of the frame 12, forward of the tank front wall 21 includes a deck plate 35 suitably fabricated to support a prime mover unit for the mud circulation system such as a diesel engine, generally designated by the numeral 34. A fuel tank 36 for supplying fuel to the engine 34 is also mounted on the forward deck 35 along one longitudinal side thereof as illustrated in FIGS. 1 and 2. The engine 34 includes a power takeoff shaft 37 which is suitably coupled to a mud circulating pump, generally designated by the numeral 38. The pump 38 is preferably of the high volume centrifugal type which is used for loading drilling fluid into the tank 18, for circulating and mixing mud in the tank and for circulating mud from the tank to the suction manifold of a high pressure delivery pump for the well circulation system. The high pressure pump is not illustrated in the drawing figures but the mud circulation unit 10 could be modified to mount such a pump onboard and drivenly connected to the engine 34 if the engine were of a suitable power rating. The engine 34 is also drivably connected through a suitable drive train to an electric generator 40 which is adapted to supply electric power to certain components on board the unit 10 which will be described in further detail herein.

The pump 38 includes a housing having a fluid inlet portion 41 connected to a suction conduit 42. The conduit 42 extends through the front wall 21 of the tank 18 and includes an inlet end disposed in a sump portion 43 in the tank bottom wall 23. Opposed inlet conduit branch portions 44 and 45 are also connected to the inlet conduit 42. Each of the branch portions 44 and 45 may be provided with a shutoff valve 46, as illustrated in FIG. 2, and the inlet conduit 42 may also include a suitable shutoff valve 46 between the branch portions and the tank 18 as illustrated in FIGS. 1 and 2. The housing of the pump 38 also includes a fluid outlet 48 which is connected to a discharge line 50 having a shutoff valve 51 interposed therein. A second branch or discharge conduit 52, see FIG. 6 also, is connected to the conduit 50 between the shutoff valve 51 and the pump outlet 48. The branch conduit 52 is also provided with a shutoff valve 53.

In accordance with a unique aspect of the present invention the frame member 26 for the tank 18 extends forwardly along the frame 12 and comprises a conduit which is connected to the pump discharge conduit 50. Accordingly, depending on the settings of the valves 51 and 53, fluid may be discharged into the conduit formed by the frame member 26 or, alternatively or concomitantly, fluid may be discharged from the pump 38 to the outlet or discharge conduit 52 for circulation to the aforementioned high pressure circulating pump or for unloading the tank 18.

In accordance with another particularly unique aspect of the present invention the conduit formed by the frame member 26 is connected to a branch conduit 59, as shown in FIGS. 2 and 3, including a shutoff valve 61 interposed therein. The conduit 59 extends substantially to the lateral midpoint of the tank 18, then downwardly toward the bottom wall 23 and terminates in an array of jet nozzles, each generally designated by the numeral 63. The nozzles 63 are disposed just above the bottom wall 23 and are arranged in a generally horizontal radially projecting pattern of four opposed nozzles, as illustrated.

Figure 5:
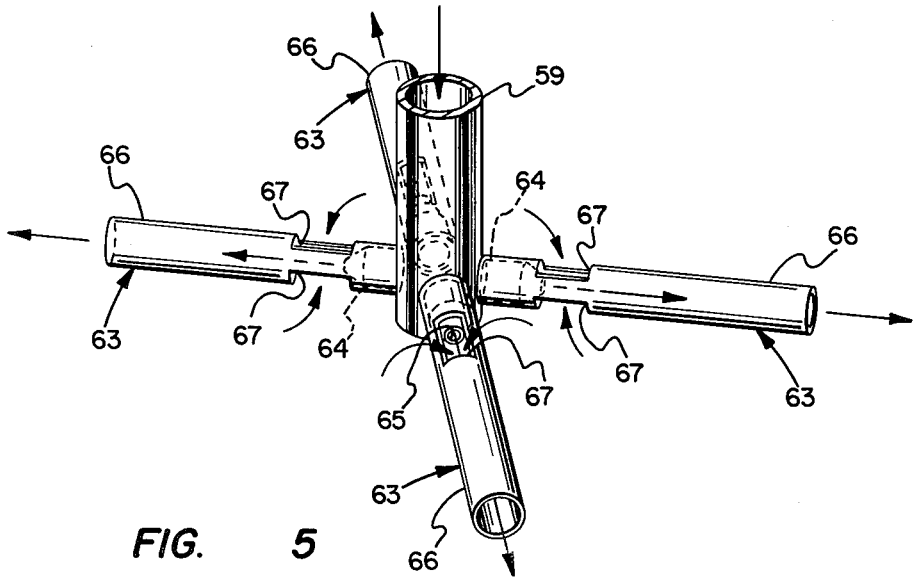
FIG. 5 is a detail perspective view illustrating the mud circulating nozzles.

Referring also to FIG. 5, each of the nozzles 63 is characterized by a short conduit portion 64, including a nozzle outlet 65, and a sleeve disposed over the conduit 64 and suitably welded thereto and designated by the numeral 66. The sleeves 66 include opposed lateral openings 67 adjacent the nozzle outlets 65. By arranging the array of nozzles 63 in the bottom of the tank 18 as illustrated mud may be withdrawn from the tank 18 through the pump suction conduit 42 and pumped through the discharge conduit 50-26-59 and through the nozzles 63 to continually circulate and agitate the mud to prevent freezing in ambient weather conditions which might be conducive to such, and also to circulate the mud to maintain any additives thoroughly dispersed throughout the mud stored in the tank 18. The nozzle array disposed at the end of the conduit 59 is preferably located generally midway between the end walls 21 and 22 as well as between the sidewalls 19 and 20. The sleeves 66 provide an ejector effect for inducing added circulation of mud by drawing mud through the openings 67 to be entrained with the jet stream being ejected from the nozzle outlets 65.

Referring further to FIGS. 1, 2 and 3, the unit 10 also includes a mud blending and/or injection unit, generally designated by the numeral 70. The mud blending unit 70 is characterized by a hopper 71 having a bottom portion in communication with a fitting 75 interposed in a branch conduit 72 connected to the conduit 26 downstream of the conduit 59. The hopper 71 includes top horizontal opposed support plates 73 for supporting containers of mud additives to be introduced into the hopper 71. The conduit 72 includes a shutoff valve 74 and a secondary conduit portion 76 connected to the hopper 71 for washing and circulating material disposed in the hopper. The secondary blending unit conduit portion 76 also includes a shutoff valve 69 interposed therein. The conduit 72 includes a downwardly depending outlet portion 77 for discharging mud into the interior of the tank 18. The mud additive blending unit 70 may be of a type commercially available and basically characterized by the arrangement of a jet nozzle formed in the fitting 75 for entraining additive material poured into the hopper 71 with fluid flowing through the conduit 72 for discharge into the interior of the tank 18.

Referring now to FIGS. 1, 2 and 5 the mud circulating and storage system of the present invention also includes an apparatus for degassing mud returned to the circulating tank 18 from the well circulation system. In the arrangement illustrated in FIG. 1 the degassing apparatus includes an elongated vertically disposed vessel, generally designated by the numeral 80, having a mud inlet conduit 81 which may be suitably connected to the well mud circulation system, not shown. The mud degassing vessel 80 is provided with suitable interior baffling or the like, not shown for separating entrained gases from mud flowing into the interior of the vessel, which gases may be vented through a suitable outlet conduit 79. The mud degassing vessel 80 may be of conventional construction and in itself forms no part of the present invention. A degassed mud outlet conduit 82 is connected to the bottom of the degassing vessel 80 and leads to the inlet of a solids separation apparatus, generally designated by the numeral 84. The conduit 82 includes a removable section 83 including spaced apart flanged connections which permit breaking the conduit 82 and removing a substantial portion thereof between the flanged connections. The inlet conduit 81 also includes a separable section 85 between similar spaced flanged connections so that the degassing vessel 80 may be disconnected from the inlet and outlet conduits and lowered into the interior of the tank 18 for over-the-road transport of the unit 10 whereby minimum bridge or tunnel clearances may be accommodated. The solids separating apparatus 84, also known in the art as a shale shaker, is suitably mounted on the deck 30 for receiving drilling mud from the degassing vessel 80 and for processing the mud therethrough. Mud separated from solids in the unit 84 is discharged directly from the bottom of the unit through a suitable opening in the deck 30 and into the tank 18. Solids separated from the drilling mud are discharged through a chute 93 to a suitable disposed apparatus, not shown. The solids separation unit 84 may be of a type commercially available such as a shale shaker unit manufactured by the Oil Field Service Division of SWECO, Inc., Austin, Texas.

The degassing vessel 80 is preferably required to be a vertically oriented tower type vessel having a suitable internal baffle system for degassing fluids flowing therethrough. The vessel 80 is adapted to be extended above the deck 30 in the operative position shown in FIGS. 1, 3 and 4 so that the outlet conduit 82 may be connected to the inlet of the solids separating unit 84. Accordingly, the vessel 80 must also be retracted to provide suitable bridge clearance for the unit 10 when it is transported over-the-road. In this regard a unique mounting arrangement for the degassing vessel is provided in accordance with the present invention.

Figure 7:
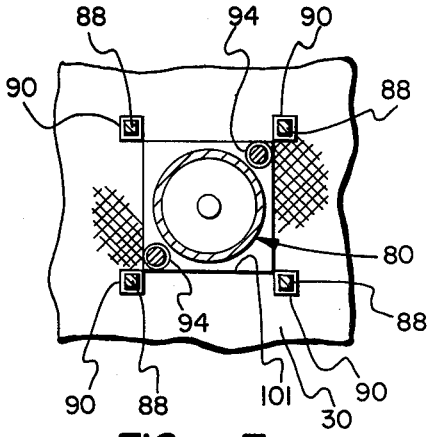
FIG. 7 is a section view taken from the line 7—7 of FIG. 3.
Figure 4:
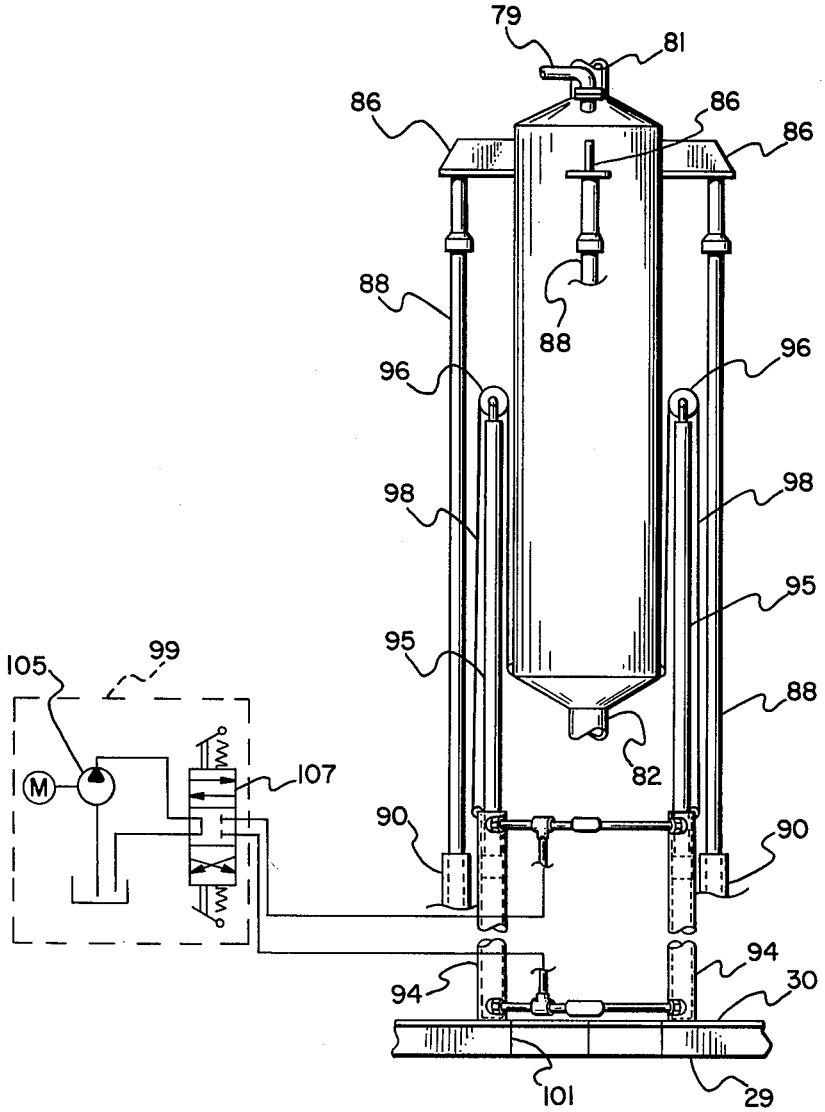
FIG. 4 is a detail elevation view showing the arrangement for elevating the mud degassing vessel.

Referring to FIGS. 3, 5 and 7, in particular, the degassing vessel 80 includes four radially projecting bracket portions 86 suitably welded to the upper side exterior of the vessel 80 and also connected to vertically depending elongated column members 88, respectively. The column members 88 are disposed in telescoping relationship within respective upstanding tubular column members 90 which extend through the deck 30 and into the interior of the tank 18 to the bottom wall 23. The column members 90 are suitably connected to each other by transverse braces 92, FIG. 3. The vessel 80 is adapted to be raised and lowered by a pair of hydraulic cylinder and piston type actuators 94 extending vertically and parallel to each other, and which are supported on frame means including the deck 30 so as to have their piston rods 95 extending upwardly in supportive relationship to respective rotatable chain sprockets 96. The sprockets 96 are engageable with respective roller chains 98 which are trained over the sprockets and secured to the outside of the cylinders 94 at one end. The opposite ends of the chains 98 are suitably secured to the bottom of the degassing vessel 80 as shown in FIG. 4. The cylinder actuators 94 are connected to a hydraulic power supply unit on board the unit 10 and generally designated by the numeral 99. As shown in FIG. 4 the power supply unit 99 preferably includes an electric motor driven pump 105 which is connected to the cylinder actuators 94 through a valve 107. Suitable conduits interconnect the power supply unit 99 and the cylinders 94 for actuating the cylinders to raise and lower the vessel 80 through an opening 101 in the deck 30 while the vessel is further guided and supported by the column members 88 and 90. The power supply unit 99 and the motive means for the solids separator unit 84 may be electrically powered and suitably connected to the generator 40 so that the unit 10 is substantially self contained and self powered.

A preferred mode of operating the portable drilling mud unit 10 is believed to be evident from the foregoing description. However, briefly, upon placing the unit 10 at a preferred site in proximity to a well to be drilled the actuators 94 are energized to raise the degassing vessel 80 from its retracted position, partially within the tank 18, to the extended position illustrated in FIG. 5. The removable conduit sections 83 and 85 are then connected to the vessel 80 and the inlet conduit 81 and the discharge conduit 82 leading to the solids separator unit. The gas vent line 79 is suitably routed away from the unit 10 to a collection means, not shown. The circulating pump discharge conduit 52 is also then suitably connected to the inlet to the high pressure mud pump, if same is to be used.

If the tank 18 is filled with a sufficient quantity of mud to commence circulation, valve 46 on inlet conduit 42 and valve 53 are opened to commence circulation of mud, upon operation of the pump 38. If only a portion of the discharge of the pump 38 is required for well circulation mud will also be circulated back to the tank 18 through the discharge conduit 50-26-59 wherein thorough mixing and circulation of the mud in the tank 18 is maintained to prevent freezing and/or to maintain mud additives thoroughly dispersed throughout the tank. If additional additives or mud components are required to be blended into the mixture in the tank 18, the blending unit 70 is placed in operation by opening the valve 74 and adding materials as required through the hopper 71 to be discharged into the tank 18. The proportions of flow being discharged through the conduits 50 and 52 may, of course, be controlled by the settings of the valves 51 and 53. Flow of mud through the blending unit 70 may be controlled by the setting of the valves 74 and 61.

Mud returning from the well circulation system is, of course, continually degassed and cleaned by the apparatus 80 and 84.

If it is desired to offload the tank 18 or to increase the quantity of mud in the tank the pump 38 may also be used in this regard by, in the latter instance, connecting either one of the inlet conduit portions 44 or 45 to a source of fluid.

Those skilled in the art will appreciate that a unique portable mud circulation, cleaning and storage unit is provided by the present invention. Although the portable unit described is arranged in combination with a semi-trailer the system may be adapted for use in combination with a suitable self propelled undercarriage or a double axle trailer also. Art workers will also recognize that various substitutions and modifications may be made to the invention disclosed herein without departing from the scope and spirit thereof as recited in the appended claims.

What is claimed is:

1. A portable drilling mud circulation and storage unit comprising:

a wheeled undercarriage including frame means;

a mud storage tank supported on said frame means;

a circulating pump disposed on said frame means, said pump including an inlet conduit connected to said tank for withdrawing mud from said tank, a discharge conduit connected to said pump and including a first conduit portion adapted to be connected to a well circulation system, and a second conduit portion of said discharge conduit connected to said tank for recirculating mud back to said tank;

valve means in said first and second conduit portions for selectively controlling the flow of mud therethrough;

mud circulation nozzle means disposed in said tank and connected to said second conduit portion for discharging a jet stream of mud into said tank for agitating mud stored in said tank;

said second conduit portion including a vertically extending end part terminating adjacent a bottom wall of said tank and having said nozzle means projecting substantially horizontally therefrom; and a mud blending unit including means interposed in a branch conduit connected to said second conduit portion for injecting additives into mud being circulated to said tank, said branch conduit having an outlet end for discharging mud mixed with additives into said tank for being mixed with mud agitated by said nozzle means.

2. The unit set forth in claim 1 wherein:

said blending unit is mounted generally above said tank, and said unit includes means forming operator access to said blending unit, said access means including an access ladder leading to deck means over said tank.

3. The unit set forth in claim 1 wherein:

said second conduit portion includes an elongated tubular frame member extending along the top of a sidewall of said tank and forming a part of supporting frame means for said tank.

4. The unit set forth in claim 1 wherein:

said pump includes an engine drivably connected thereto and mounted on said frame means.

5. The unit set forth in claim 1 wherein:

said nozzle means includes a plurality of jet nozzles projecting radially from said end part of said second conduit portion and spaced apart angularly one from the other, said nozzles each including ejector sleeves extending therefrom and including means forming an opening in the sidewall of said ejector sleeves and adjacent the outlet of said respective nozzles for conducting mud in said tank to be entrained with mud being ejected from said nozzles.

6. A portable drilling mud circulation and storage unit comprising:

a wheeled undercarriage including frame means;

a mud storage tank including opposed sidewalls, opposed end walls and a bottom wall, said tank being supported on said frame means;

a circulating pump disposed on said frame means, said pump including an inlet conduit connected to said tank for withdrawing mud from said tank, a discharge conduit connected to said pump and including a first conduit portion adapted to be connected to a well circulation system, and a second conduit portion connected to said tank for recirculating mud back to said tank;

valve means in said first and second conduit portions for selectively controlling the flow of mud therethrough;

mud circulation nozzle means disposed in said tank and connected to said second conduit portion for discharging a jet stream of mud into said tank for agitating mud stored in said tank;

said second conduit portion including an elongated tubular frame member extending along the top of one of said sidewalls of said tank and forming a part of said frame means of said tank, and a vertically extending end part of said second conduit portion terminating adjacent said bottom wall of said tank and having said nozzle means projecting substantially horizontally therefrom.

7. A portable drilling mud circulation and storage unit comprising:

a wheeled undercarriage adapted for over the road transport and including frame means for supporting a mud storage tank, said tank including means forming a bottom wall, side walls and end walls, an inlet conduit for receiving mud, discharge means for discharging cleaned mud to said tank, and a suction conduit in communication with said tank for withdrawing cleaned mud from said tank for recirculation through a well, support means on said tank for supporting a degassing vessel connected to said inlet conduit, and a conduit interconnecting said degassing vessel and said discharge means for conducting degassed mud to said tank;

said degassing vessel comprising an elongated upstanding tower mounted on said tank and connected to means for moving said degassing vessel between a vertically extended working position extending above said tank and a vertically retracted transport position at least partially in said tank wherein said degassing vessel is disposed to provide clearance of overhead road obstructions during transport of said circulation and storage unit.

8. The unit set forth in claim 7 including:

guide means for said degassing vessel including a plurality of vertically extending guide columns connected to said degassing vessel and slidably journalled by cooperable guide means on said tank.

9. The unit set forth in claim 7 including:

hydraulic actuator means connected to said degassing vessel and operable to move said degassing vessel between said working and transport positions.

10. The unit set forth in claim 9 wherein:

said actuator means include a pair of parallel vertically extending hydraulic cylinder actuators connected to sprocket means engageable with elongated flexible chain means trained over said sprocket means and fixed at one end and secured to a lower end portion of said degassing vessel at their opposite ends, respectively.

11. The unit set forth in claim 7 including:

disconnectable conduit sections interposed in said inlet and discharge conduits of said degassing vessel.

12. The unit set forth in claim 7 including:

a circulating pump including a prime mover drivably connected thereto and mounted on board said unit, said suction conduit being connected to said pump and said tank for withdrawing mud from said tank, and a discharge conduit connected to said pump and adapted to be connected to a well circulation system.

13. The unit set forth in claim 7 including:

a solids separating unit mounted above said tank and connected to said degassing vessel and operable to receive degassed mud from said degassing vessel and to discharge separated mud directly to said tank.

* * * * *